US005871216A

United States Patent [19]

Sparacino

[11] Patent Number: 5,871,216

[45] Date of Patent: Feb. 16, 1999

[54] BEAN BAG TOSS GAME

[76] Inventor: Thomas Sparacino, 3N264 Lorretta Dr., St. Charles, Ill. 60175

[21] Appl. No.: 876,586

[22] Filed: Jun. 16, 1997

[51] Int. Cl.[6] ..... A63B 63/00

[52] U.S. Cl. ..... 273/402

[58] Field of Search ..... 273/127 R, 402

[56] References Cited

U.S. PATENT DOCUMENTS

| | | | |
|---|---|---|---|
| D. 340,082 | 10/1993 | DeLapa | D21/5 |
| 2,128,486 | 8/1938 | King | 273/127 R |
| 4,943,065 | 7/1990 | DeLapa | 273/402 |
| 4,961,586 | 10/1990 | Conville | 273/402 |
| 5,056,796 | 10/1991 | Conville | 273/402 |
| 5,165,695 | 11/1992 | Yoder | 273/402 |
| 5,332,230 | 7/1994 | Benedict | 273/402 X |

*Primary Examiner*—William H. Grieb
*Attorney, Agent, or Firm*—Jonathan E. Grant

[57] ABSTRACT

A bean bag toss game is disclosed wherein the pieces of the game are assembled by means of grooves cut into the various sections of the game, allowing the sections of the game device to be secured without screws or collapsible legs. Such an arrangement makes the game sturdier, allows for easy assembly, disassembly, and storage, and allows the game to withstand the impact of small children jumping on the board, thereby reducing the possibility of injuries.

5 Claims, 2 Drawing Sheets

BEAN BAG TOSS GAME

BACKGROUND OF THE INVENTION

1. Field of the Invention

The present invention discloses a bean bag toss game.

2. Description of the Prior Art

Over the years, there have been a number of developments for the improvement of the bean bag toss game.

U.S. Pat. No. 4,943,065 (DeLapa) discloses a target structure for a bean bag tossing game which has a target surface member having a smooth surface texture and a flexibility or spring action such that when a bean bag strikes the surfaces, it may either slide or bounce depending upon the angle of incidence of the striking bag. The structure is supported off of the ground plane by substantially vertical support members which set the target surface member at an angle with respect to the ground plane. The target surface member and the supporting members are from a single plastic sheet and the support-members are hinged from the target surface member via a living hinge connection formed in the plastic. The front and rear support members are connected along vertical edges to the side support members by hook and loop fastening material affixed to mating edges of adjacent support members. The game may be made of plastic.

U.S. Pat. No. 4,961,586 (Conville) discloses a bag tossing game comprising first and second target assemblies adapted to either be coupled to one another to dispose the tossing game in a transportable mode or to be separated and detached from one another to dispose the game in a playing mode, with each of the assemblies having a resilient playing board comprising an aperture penetrable by said projectiles, leg means projecting away from the board, and socket means defined in each playing board for mating with and receiving leg means emanating from the other playing board when the boards are fitted together, and elevator tray means associated with each playing board adapted to be selectively coupled thereto.

U.S. Design Patent No. 340,082 (DeLapa) discloses an ornamental beanbag tossing game target having a hinged leg structure to support the top portion of the game.

U.S. Pat. No. 5,332,230 (Benedict) discloses a bag toss game apparatus comprising a foldable target structure which includes first, second and third game plates or sides, each having distinctive geometrical configurations arranged for opening an securement in a triangular configuration, wherein a central opening includes a central opening periphery fastener structure about the central opening through each game plate, with the plates being hinged to each other to fold and mount the game for use during play.

U.S. Pat. No. 5,165,695 (Yoder) discloses a transportable bag tossing game. Each target structure is comprised of a single injection molded part having a first wall disposed relatively perpendicular to the supporting plane and an angled second wall having an aperture located along the central longitudinal axis of the target structure.

U.S. Pat. No. 5,056,796 (Conville) discloses a self contained bag tossing game. Each target assembly comprises a resilient, generally rectangular plastic playing board which includes a target aperture. Each target board is inclined for play by two elevator trays which are pivotally coupled to each board. For storage, each elevator tray can be folded into position on the underside of the target board.

Each of the above described inventions have drawbacks. Those toss games that are comprised of a one piece solid structure are difficult to store. Other toss games which have either a hinged elevator tray or feet, or which are screwed together, have a danger of collapsing when small or medium sized children stand or jump on the playing board, as children are prone to do. Consequently, it is helpful to have a toss game which is of the safest possible design.

SUMMARY OF THE INVENTION

The present invention proposes a toss game wherein the pieces of the game are fitted together by means of grooves cut into the various sections of the game, allowing the sections of the game device to be secured without screws or collapsible legs. Such an arrangement provides for a more secure game, which can be disassembled for easy storage. The toss game comprises a top platform, two base sides, a base back, a base front, and at least one bean bag.

Each base board has cut outs. To assemble the sides are slid into the back and front boards. After the base boards are slid together, the top platform is placed on top.

The toss game may be made out of wood, plywood, durable plastic, metal, or any other durable material. The base sides are trapezoid in shape, the base sides having an outer side, an inner side, a back section, a front section, a top edge and a bottom edge. Each of the two base sides have two slots or grooves cut into the sides, the grooves emanating from the bottom section of the trapezoid, with one groove cut near the back section, and the other groove cut near the front section. The back section of each of the base sides having a height greater than the front section of the base sides. The top section has two boards attached to the underside of the platform. The attached boards will lie on the outside of the front base board and the outside of the back base board. In a preferred embodiment, Velcro® or hook strips are positioned near the top section of the base sides. These hook strips can attach to a cloth material positioned on the bottom underside of the platform piece.

BRIEF DESCRIPTION OF THE DRAWINGS

The above and other objects, features and advantages of the present invention will become more readily apparent from the following description, reference being made to the accompanying drawings in which.

DESCRIPTION OF THE PREFERRED EMBODIMENT

Figure 1:
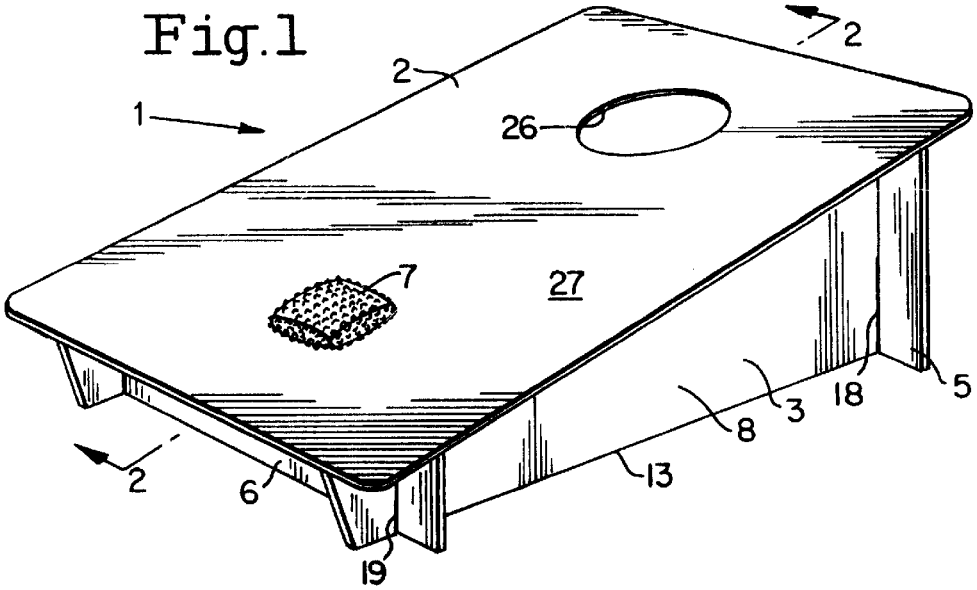
FIG. 1 is an overhead angular view of the present invention.
Figure 2:
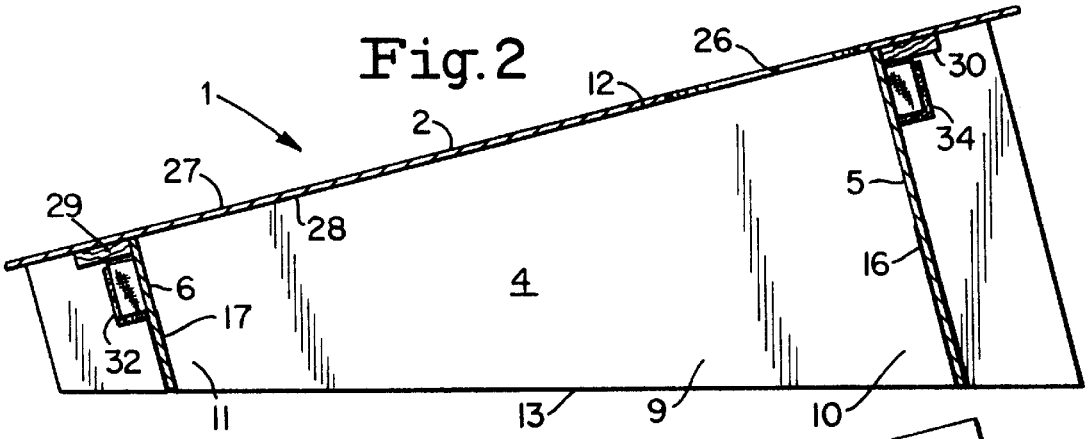
FIG. 2 is a cross-sectional view taken along Lines 2—2 of figure one.
Figure 3:
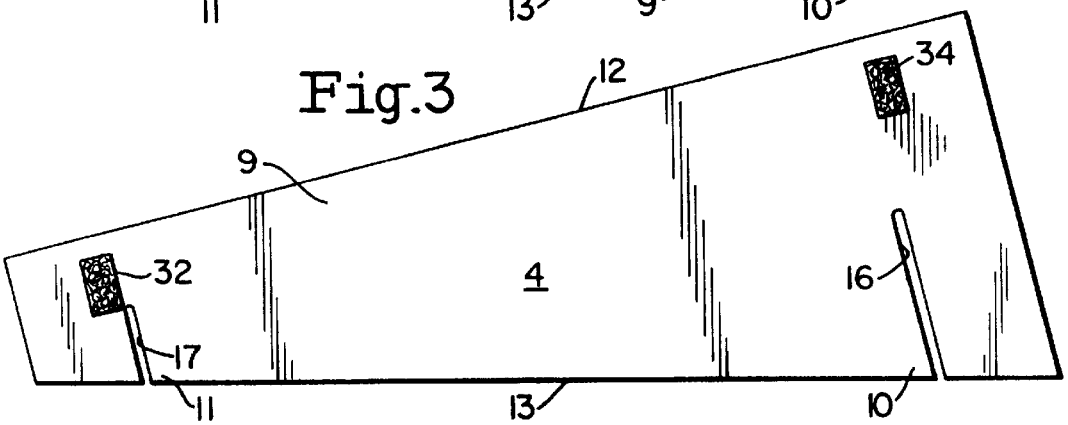
FIG. 3 is an elevational view of the inside of one side wall.
Figure 4:
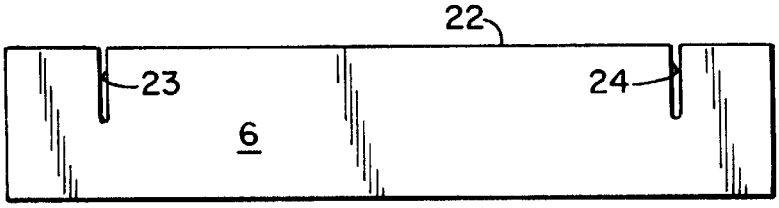
FIG. 4 is a frontal view of the base front.
Figure 5:
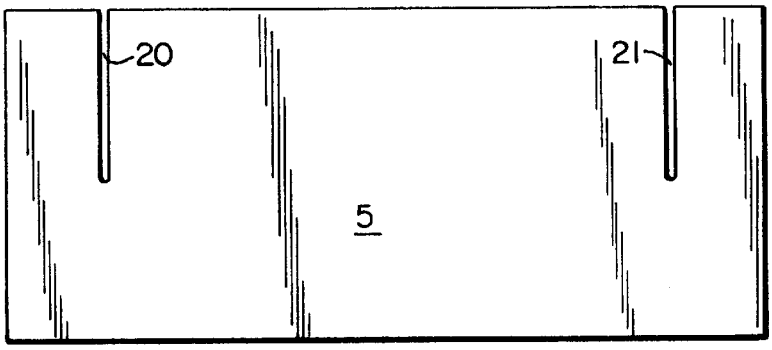
FIG. 5 is a frontal view of the base back.
Figure 6:
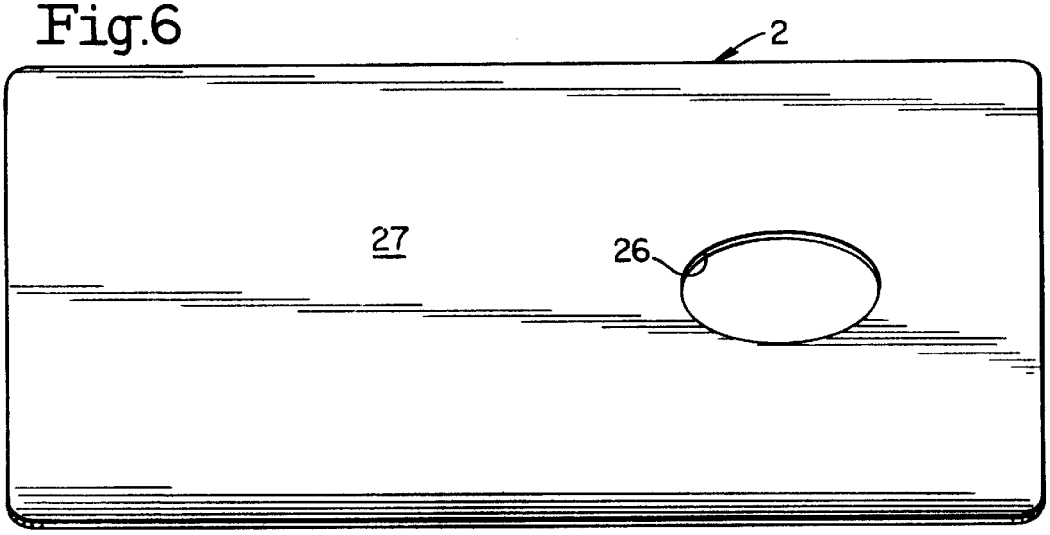
FIG. 6 is an overhead oblique view of the top platform.
Figure 7:
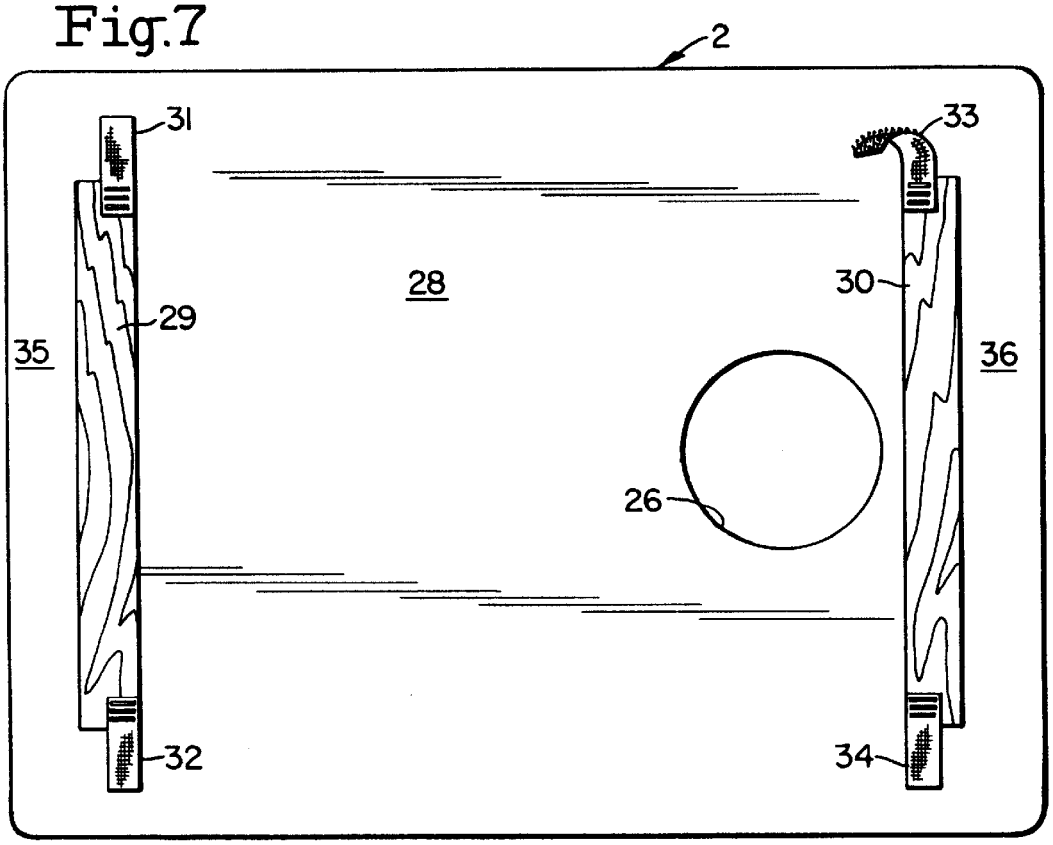
FIG. 7 is a view of the underside of the top platform.

Referring to FIGS. 1–7, the bean toss game 1 comprises a top platform 2, at least two base sides 3 and 4 residing opposite to each other, preferably a base back 5, and a base front 6, and at least one bean bag 7. In a preferred embodiment, there are at least six bean bags 7, with three sets of two bags having the same color. The base sides 3 and 4 each have an outer side 8, an inner side 9, a back section 10, a front section 11, a top edge 12 and a bottom edge 13.

In a preferred embodiment the base sides 3 and 4 are trapezoid in shape. Both the base back 5, and the base front 6 are rectangular in shape when positioned in an upright position, with the base back 5 having a greater height than the base front 6.

In order to assemble the bean toss game 1, each of the base sides comprise at least two grooves 16 and 17, and 18 and 19, extending perpendicularly from the bottom edge of each of the base sides. One of the grooves 16 and 18 of each of the base sides 3 and 4 is positioned near the back section 10 of each of the base sides 3 and 4, and the other grooves 17 and 19 are each positioned near each of the front sections 11 of each of the base sides 3 and 4. The base back 5 also comprises at least two grooves 20 and 21, extending perpendicularly from the top of the base back 5, wherein one of the grooves 20 of the base back 5 is positioned near one corner of the base back 5, and the other groove 21 is positioned in another corner of said base back 5.

Similarly, the base front 6 further comprises at least two grooves 23 and 24, extending perpendicularly from the top 22 of said base front 6, wherein one of the grooves 23 of the base front 6 is positioned near one corner of the base front 6, and the other groove 24 is positioned in another corner of the base front 6.

The top platform 2 of the bean toss game 1 has an opening 26, through which the bean bag 7 is tossed. The top platform has a top side 27 and a bottom underside 28, a front section 35 and a back section 36. Two cross pieces 29 and 30, positioned on the bottom underside 28 running perpendicularly to the length of the top platform. In a preferred embodiment of the invention Velcro$^R$ strips 31, 32, 33, and 34 overlap each end of each cross piece. Complementary to the Velcro$^R$ strips on the each end of the cross piece are Velcro$^R$ strips (hook and loop fasteners) positioned at the front section 11 and the back section 10 on the inner side 8 of each of the base sides 3 and 4. In a preferred embodiment, the base sides further comprise hook and loop fasteners on the inner sides of the top edges of the base sides.

To assemble the bean bag toss game 1, the grooves 16 and 18 of the of the base sides 3 and 4 are each fitted into one groove 20 or 21 of the base back 5. Similarly, the grooves 17 and 19 of the base sides 3 and 4, are fitted into grooves 23 and 24 of the base front 6.

The top platform 2 is secured on top of the base sides 3 and 4, wherein the cross pieces 29 and 30 are fitted on the outside of the base front 6 and base back 5, whereupon the hook and loop fasteners of the top platform 2 are attached to the hook and loop fasteners of the inside of base sides 3 and 4.

Fitting the bean toss game together by means of grooves instead of nails or screws allows for a game that is sturdier, easier to put together, and safer for children. Additionally, the assembly of the game allows for easy storage.

Many modifications and variations of the present invention are possible in light of the above teachings. It is, therefore, to be understood within the scope of the appended claims the invention may be protected otherwise than as specifically described.

What is claimed is:

1. A bean bag toss game comprising:

a top platform having a front section and a back section; at least two base sides, said base sides being trapezoid in shape, wherein each of said base sides has an outer side, an inner side, a back section, a front section, a top edge, and a bottom edge, each of said base sides comprising at least two grooves, said grooves extending perpendicularly from the bottom edge of each of said base sides, wherein one of said grooves of each of said base sides is positioned near the back section of each of said base sides, and the other of said grooves is positioned near each of the front sections of each of said base sides;

a base back, said base back being rectangular in shape, said base back comprising at least two said grooves, said grooves extending perpendicularly from the top of said base back, such that one of said grooves of said base back is positioned near one corner of said base back and the other said groove is positioned in another said corner of said base back;

a base front, said base front being rectangular in shape; said base front comprising at least two grooves extending perpendicularly from the top of said base front, one of said grooves of said base front being positioned near one corner of said base front, and said other groove is positioned in another said corner of said base front, wherein said base back, when positioned in an upright position, has a greater height than when said base front is positioned in an upright position, and at least one bean bag, wherein sections of the game are fitted together by means of said grooves cut into the base sides, base back, and base front of the game, allowing the sections of the game to be secured together without benefit of screws or collapsible legs, thereby making the game very easy to assemble, and stronger.

2. The bean bag toss game of claim 1, wherein said top platform of said bean toss game has an opening through which the bean bag is tossed.

3. The bean bag toss game of claim 1, wherein said top platform has a top side, a bottom underside, a front section, and a bottom section, and said top platform further comprises two cross pieces positioned on the bottom underside, said two cross pieces positioned perpendicularly to the length of the top platform, wherein one said cross piece is positioned near the front of the bottom underside of the top platform, and said other top cross piece is positioned near the back of the bottom underside of the top platform.

4. The bean bag toss game of claim 3, wherein said top section further comprises hook and loop fasteners attached to the end of the cross pieces.

5. The bean bag toss game of claim 4, further comprising hook and loop fasteners on the inner sides of the top edges of the base sides.

* * * * *